US005685270A

United States Patent [19]

Sekiguchi et al.

[11] Patent Number: 5,685,270

[45] Date of Patent: Nov. 11, 1997

[54] IDLE SPEED CONTROL SYSTEM AND METHOD FOR DIESEL ENGINE

[75] Inventors: Akira Sekiguchi; Yosinori Uchida; Masahiro Sutoh; Osamu Mori, all of Higashimatsuyama, Japan

[73] Assignee: Zexel Corporation, Tokyo, Japan

[21] Appl. No.: 667,854

[22] Filed: Jun. 20, 1996

[30] Foreign Application Priority Data

Jun. 23, 1995 [JP] Japan ..... 7-179626

[51] Int. Cl.[6] ..... F02D 11/10; F02D 41/16

[52] U.S. Cl. ..... 123/339.21

[58] Field of Search ..... 123/339.19, 339.21, 123/339.22, 357

[56] References Cited

U.S. PATENT DOCUMENTS

| | | | |
|---|---|---|---|
| 4,513,712 | 4/1985 | Gassler et al. | 123/339.21 |
| 4,742,462 | 5/1988 | Fujimori et al. | 123/339.19 |
| 4,773,370 | 9/1988 | Koshizawa et al. | 123/357 |
| 4,780,827 | 10/1988 | Fujimori et al. | 123/339.21 |
| 5,052,357 | 10/1991 | Fujimoto et al. | 123/339.21 |
| 5,060,611 | 10/1991 | Krampe et al. | 123/339.21 |
| 5,251,598 | 10/1993 | Wietelmann | 123/339.21 |
| 5,372,110 | 12/1994 | Boverie et al. | 123/339.21 |

*Primary Examiner*—Willis R. Wolfe

*Attorney, Agent, or Firm*—Cushman Darby & Cushman Intelluctual Property Group of Pillsbury Madison & Sutro LLP

[57] ABSTRACT

A diesel engine idle speed control system and method wherein a preset running characteristic map is corrected by a learning value updated on the basis of the output of a PID under predetermined conditions for each of different engine load modes, thereby determining a desired injection quantity. The map indicates a relationship between an engine speed and a fuel injection quantity for each of accelerator openings, including an accelerator opening of zero percent. A judgment is made on the present load mode of the engine, and a basic injection quantity corresponding to the present accelerator opening and engine speed is calculated from the running characteristic map. When the vehicle operating condition is in an idle mode, learning is executed so as to optimize a feedback correction quantity used for feedback control for each load mode, and a corrected basic injection quantity is calculated from the basic injection quantity and the learning value. Relearning is executed according to a predetermined condition. Updating of the learning value is also executed according to a predetermined condition. A desired injection quantity is obtained by adding the corrected basic injection quantity and the output value of the PID to each other.

14 Claims, 3 Drawing Sheets

IDLE SPEED CONTROL SYSTEM AND METHOD FOR DIESEL ENGINE

BACKGROUND OF THE INVENTION

1. Field of the Invention

The present invention relates to an idle speed control system and method for a diesel engine. More particularly, the present invention relates to a diesel engine idle speed control system and method wherein the fuel injection quantity is controlled by effecting PID (Proportional plus Integral plus Derivative action) control using a deviation of an actual engine speed from a desired engine speed as an input for the control, thereby maintaining the actual engine speed at the desired engine speed and obtaining a stable idle speed or stable idle running. According to the present invention, a preset running characteristic map is corrected by a learning value which is repeatedly updated by learning on the basis of the PID output under predetermined conditions for each of different engine load conditions, thereby determining a desired fuel injection quantity.

2. Description of the Related Background Art

In the conventional diesel engine idle speed control, the idling engine speed is controlled so as to coincide with the desired engine speed by effecting closed-loop control using a PID controller.

The conventional diesel engine idle speed control suffers, however, from the following problems. Under different engine load conditions, the same PID output produces different effects on the engine speed. Accordingly, it is difficult with only one kind of PID parameter to effect stable idle speed control under all load conditions, and it is also difficult to minimize undershoot after the engine has been raced.

SUMMARY OF THE INVENTION

An object of the present invention is to provide a diesel engine idle speed control system and method wherein learning is executed on the basis of the PID output for each load condition to obtain an optimum learning value for each load condition as a feedback correction quantity for feedback control, thereby solving the above-described problems of the background art.

According to the present invention, a judgment is made on the present engine load mode, and a basic injection quantity corresponding to the present accelerator opening and engine speed is calculated by using a preset running characteristic map indicating a relationship between an engine speed and a fuel injection quantity for each of accelerator openings, including an accelerator opening of zero percent. Then, it is judged whether or not the vehicle is in a predetermined idle mode. When the vehicle is in the idle mode, a learning value is calculated on the basis of the output value of the PID for each load mode and stored. A corrected basic injection quantity is calculated from the basic injection quantity and the learning value on the basis of a predetermined formula according to the value of the calculated basic injection quantity. It should be noted that, once learning has been completed, relearning is executed only when a variation of the output value of the PID exceeds a predetermined value. When the actual engine speed is greater than the desired engine speed and, at the same time, the output value of the PID is zero, the learning value is updated by subtracting an update quantity of a predetermined value from the learning value until the output value of the PID reaches a predetermined value. A desired injection quantity is obtained by adding the corrected basic injection quantity and the output value of the PID to each other.

Other features and advantages of the present invention will become clear to those skilled in the art from the following detailed description, taken in connection with the accompanying drawings, and the appended claims.

BRIEF DESCRIPTION OF THE DRAWINGS

FIG. 3 is a diagram showing the intended juxtaposition of FIGS. 3*a* and 3*b*.

DESCRIPTION OF THE PREFERRED EMBODIMENTS

One embodiment of the present invention will be described below with reference to the accompanying drawings.

Figure 1:
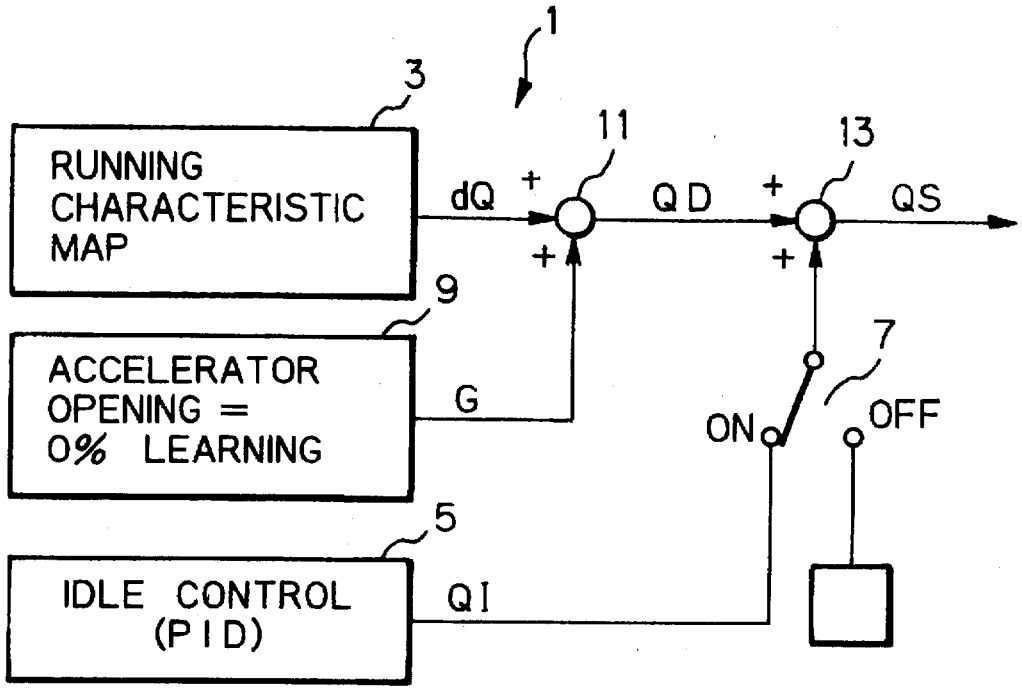
FIG. 1 is a block diagram showing an essential part of a control system according to one embodiment of the present invention.
Figure 2:
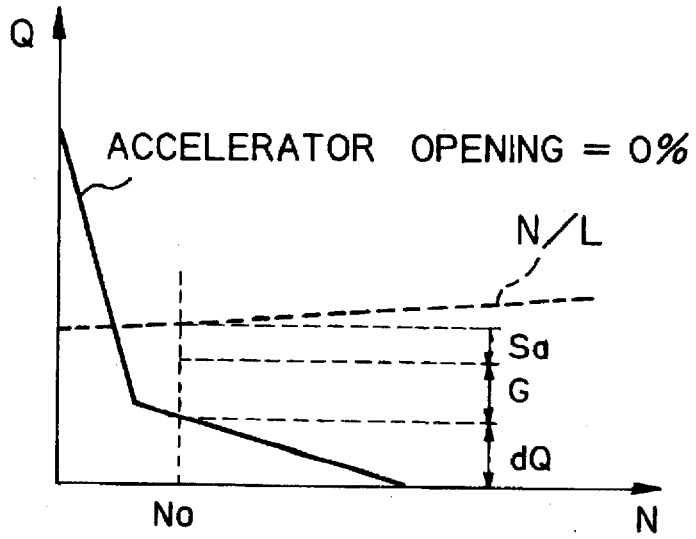
FIG. 2 is a chart showing one example of a running characteristic map.

FIG. 1 is a block diagram showing the arrangement of an essential part of a control system 1 according to the present invention. The control system 1 has a running characteristic map storage device 3 for storing a diesel engine running characteristic map. As shown in FIG. 2, the running characteristic map graphically shows a relationship between an engine speed N and a fuel injection quantity Q which has been predetermined for each accelerator opening. More specifically, FIG. 2 shows only running characteristics when the accelerator opening is 0%. In this embodiment, characteristic values at the accelerator opening 0% have been set to the lower limit values by taking into consideration individual variation among engines, injection pumps and so forth. It should be noted that the dashed line indicated by reference character N/L in FIG. 2 shows the relationship between the engine speed and the fuel injection quantity under no-load conditions.

The running characteristic map storage device 3 is provided with a basic injection quantity calculating device which calculates a basic injection quantity dQ corresponding to the present accelerator opening and engine speed, which are detected with respective sensors, by using the running characteristic map.

A PID controller (hereinafter referred to as simply "PID") 5 for effecting idle speed control is supplied with as an input a deviation of an actual engine speed Nr from a desired engine speed No. The PID controller 5 performs an arithmetic operation by using predetermined PID parameters to calculate and output a PID value QI as a manipulated variable for feedback control. A change-over switch 7 is changed over by an idle mode judging device which judges whether or not the vehicle operating condition is in an idle mode, and which on-off controls the 1die speed control operation on the basis of the judgment.

A learning device 9 calculates a learning value G from the output value of the PID on the basis of a predetermined formula under predetermined conditions.

The basic injection quantity dQ and the learning value G are added to each other at a summing point 11 to obtain a corrected basic injection quantity QD. Then, the corrected base injection quantity Q and the PID value, which is the PID output, are added to each other at a summing point 13 to obtain a final desired injection quantity QS.

The control method according to the present invention will be explained below with reference to the flowchart of FIG. 3.

Figure 3A:
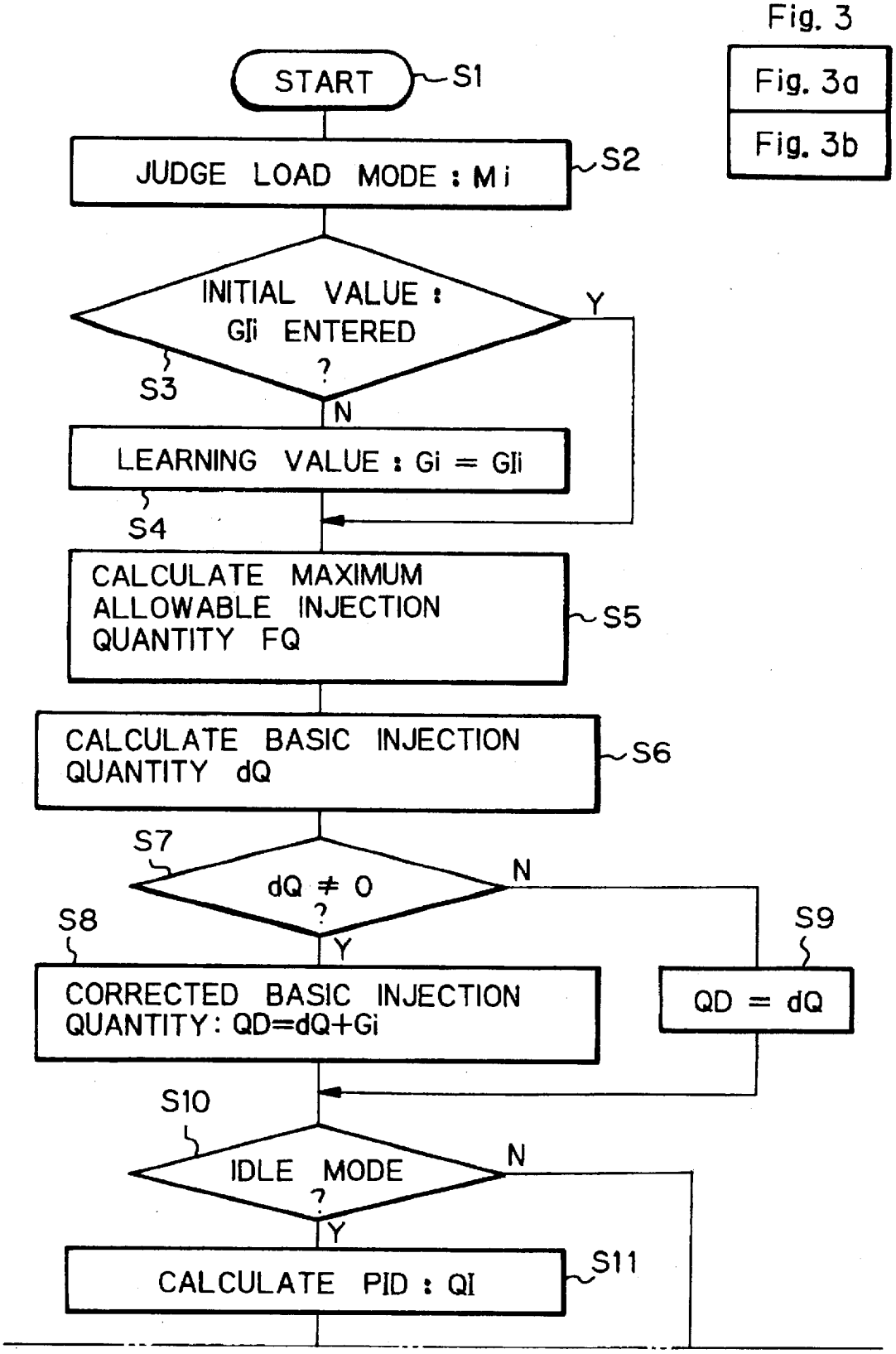
FIGS. 3*a* and 3*b* show in conjunction a flowchart showing a control task executed by the control system according to the embodiment.
Figure 3B:
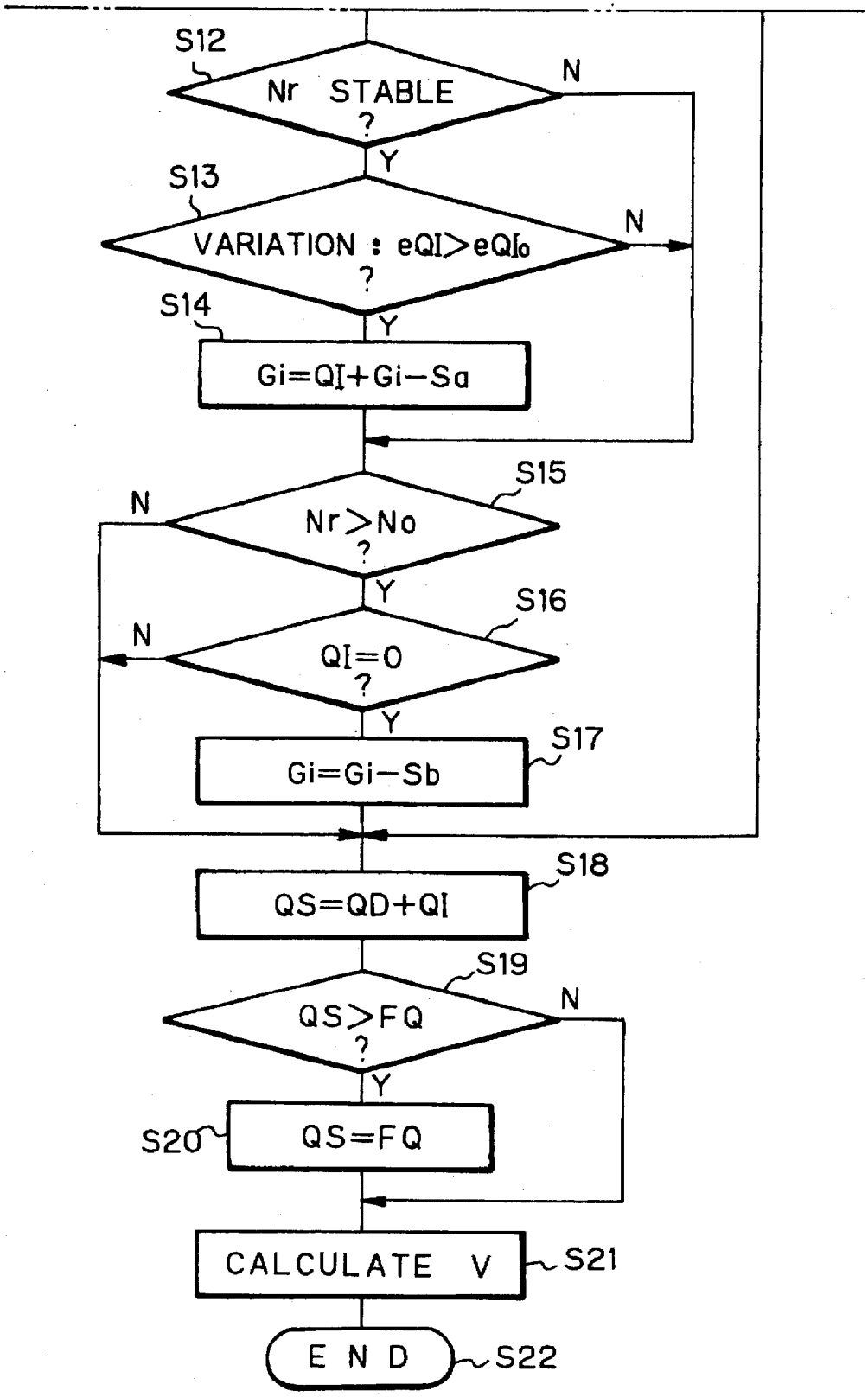

When the engine is started, the control task shown in FIG. 3 starts (step S1). The task is repeated every 10 ms, for example.

At step S2, a judgment on the present engine load mode is made. That is, a judgment is made about the load condition in which the engine is being operated. Discrimination among load modes is made on the basis of signals from various sensors such as an air conditioner sensor, etc. In this embodiment, a judgment is made to discriminate among 5 different load modes Mi, i.e. a normal state, an air conditioner ON state, an idle up state due to battery voltage drop, a state other than neutral, and a state other than air conditioner ON plus neutral.

At step S3, it is judged whether or not a learning initial value GIi for a load mode Mi judged to be presently working has been entered. The learning initial value GIi is a value preset for each load mode. If the learning initial value GIi has not yet been entered, the process proceeds to step S4, at which the learning initial value GIi corresponding to the load mode Mi judged at step S2 is stored in the learning device 9 as a learning value Gi, and a flag is set to indicate that the initial value GIi has been entered. If the initial value GIi has already been entered, the process proceeds to step S5 from step S2.

At step S5, a maximum allowable injection quantity FQ which is allowable under the present engine operating conditions is calculated. Next, at step S6, a basic injection quantity dQ corresponding to the present accelerator opening and engine speed Nr is calculated by using the running characteristic map. Although FIG. 2 shows only the running characteristics when the accelerator opening is 0% , running characteristics corresponding to other accelerator openings have also been determined. Therefore, at step S6, a basic injection quantity dQ corresponding to the actual accelerator opening is calculated.

Next, it is judged at step SV whether or not the basic injection quantity dQ is zero. If it is not zero, the process proceeds to step S8, at which a value determined by adding the learning value Gi to the basic injection quantity dQ is defined as a corrected basic injection quantity QD. If the basic injection quantity dQ is zero, the process proceeds to step S9, at which the basic injection quantity dQ is defined as a corrected basic injection quantity QD without adding the learning value Gi to the basic injection quantity dQ.

At step S10, it is judged whether or not the vehicle is presently in an idle mode. The judgment is made on the basis of signals from sensors respectively indicating an accelerator opening, a vehicle speed, and an engine speed. The change-over switch 7, shown in FIG. 1, is properly changed over on the basis of the judgment.

If the vehicle is not in the idle mode, the process proceeds directly to step S18 (described later). If the vehicle is in the idle mode, the process proceeds to step S11, at which an arithmetic operation is performed by PID on the basis of a deviation en of the actual engine speed Nr from a desired idle speed No to calculate a PID value QI. It should be noted that the desired idle speed No is determined on the basis of the water temperature, the engine load, etc.

At step S12, it is judged whether or not the engine speed is stable. The engine speed is judged to be "stable" when it is consecutively detected a predetermined number of times that the difference between the desired idle speed No and the actual engine speed Nr is smaller than a predetermined criterion.

Next, it is judged at step S13 whether or not the variation of the PID value QI is larger than a predetermined criterion. That is, it is judged whether or not a difference eQI between the PID value QI obtained when the previous learning value Gi was subjected to learning and the presently calculated PID value QI exceeds a criterion eQIo. If the variation eQI of the PID value QI is larger than the criterion eQIo, learning is executed again at step S14. That is, the presently calculated PID value QI is added to the previous learning value Gi, and a preset offset quantity Sa is subtracted from the resulting sum to obtain a new learning value Gi. Then, the process proceeds to the subsequent step S15. That is, once learning has been completed, relearning is not executed until the variation QI of the PID value QI exceeds the criterion eQIo. It should be noted that, if NO is the answer at step S12 or S13, the process proceeds directly to step S15.

Next, it is judged at step S15 whether or not the actual engine speed Nr exceeds the desired idle speed No. If YES, it is judged at step S16 whether or not the PID value QI is zero. If YES, the process proceeds to step S17, at which an update quantity Sb of a predetermined value is subtracted from the learning value Gi to update the learning value Gi. Then, the process proceeds to step S18. The updating of the learning value Gi is repeated until the manipulated variable QI becomes unequal to zero, more specifically, until the calculated PID value QI becomes equal to the value of the above-mentioned offset quantity Sa. It should be noted that, if NO is the answer at step S15 or S16, the process proceeds directly to step S18.

At step S18, the corrected basic injection quantity QD obtained at step S8 or S9 and the PID output QI are added to each other to determine a final desired injection quantity QS. Then, it is judged at step S19 whether or not the final desired injection quantity QS is larger than the maximum allowable injection quantity FQ calculated at step S5. If YES, the maximum allowable injection quantity FQ is defined as a final desired injection quantity QS, and the process proceeds to step S21. If the final desired injection quantity QS is not larger than the maximum allowable injection quantity FQ, the process proceeds directly to step S21. At step S21, a voltage V which is to be applied to the actuator of the injection pump is calculated correspondingly to the final desired injection quantity QS. Thereafter, the process is terminated at step S22.

As has been described above, in the present invention learning is executed for each load mode of the engine so as to optimize a feedback controlled variable used for feedback control for each load mode. Accordingly, optimum idle speed control can be realized in all load modes. In addition, even when load modes change over from one to another, control based on a learning value for the new load mode is immediately started. Therefore, load modes smoothly change without causing the occupant of the vehicle to have an odd feeling. Further, the present invention makes it possible to effect extremely favorable idle speed control regardless of individual variation among engines and injection pumps and irrespective of deterioration with age of the engine and injection pump used because learning is executed to provide an optimum learning value for the engine and injection pump which are in action.

Although the present invention has been described through specific terms, it should be noted here that the described embodiment is not necessarily exclusive and that various changes and modifications may be imparted thereto without departing from the scope of the invention which is limited solely by the appended claims.

What is claimed is:

1. An idle speed control system for a diesel engine on a vehicle wherein a fuel injection quantity is controlled by PID control using a deviation of an actual engine speed from a desired engine speed as an input for said control, thereby converging said actual engine speed to said desired engine speed, said control system comprising:

running characteristic map storage means for storing a preset running characteristic map indicating a relationship between an engine speed and a fuel injection quantity for each of accelerator openings, including an accelerator opening of zero percent;

load mode judging means for making a judgment on a present load mode of said engine;

basic injection quantity calculating means for calculating a basic injection quantity corresponding to a present accelerator opening and engine speed from said running characteristic map;

idle mode judging means for judging whether or not said vehicle is in a predetermined idle mode from an operating condition of said vehicle;

learning means for calculating a learning value on the basis of an output value of said PID for each load mode when said vehicle is in the idle mode, and for storing said learning value;

corrected basic injection quantity calculating means for calculating a corrected basic injection quantity from said basic injection quantity and said learning value on the basis of a predetermined formula according to a value of said basic injection quantity;

relearning judging means for causing said learning means to calculate a new learning value only when a variation of the output value of said PID exceeds a predetermined value;

learning value updating means for updating, when said actual engine speed is greater than said desired engine speed and, at the same time, the output value of said PID is zero, said learning value by subtracting an update quantity of a predetermined value from said learning value until the output value of said PID reaches a predetermined value; and desired injection quantity calculating means for calculating a desired injection quantity by adding said corrected basic injection quantity and the output value of said PID to each other.

2. An idle speed control system according to claim 1, further comprising:

means for calculating a maximum allowable injection quantity according to each operating condition of said engine, so that, when the desired injection quantity calculated by said desired injection quantity calculating means is greater than said maximum allowable injection quantity, said desired injection quantity is replaced by said maximum allowable injection quantity.

3. An idle speed control system according to claim 1, further comprising:

engine speed stability judging means for judging whether or not the engine speed is stable, so that the learning by said learning means is executed when said engine speed is stable.

4. An idle speed control system according to claim 3, wherein said engine speed stability judging means calculates a difference between a desired idle speed and an actual engine speed.

5. An idle speed control system according to claim 4, wherein said engine speed stability judging means judges that said engine speed is stable when a state wherein a difference between said desired idle speed and the actual engine speed is smaller than a predetermined value has continued for a predetermined time.

6. An idle speed control system according to claim 1, wherein, when said relearning judging means decides to execute relearning, said learning means subtracts a predetermined offset quantity from a sum of the previously calculated learning value and the output value of said PID to obtain a new learning value and stores it.

7. An idle speed control system according to claim 6, wherein said learning value updating means continues updating said learning value until the output value of said PID becomes equal to said offset quantity.

8. An idle speed control method for a diesel engine on a vehicle wherein a fuel injection quantity is controlled by PID control using a deviation of an actual engine speed from a desired engine speed as an input for said control, thereby converging said actual engine speed to said desired engine speed, said control method comprising the steps of:

making a judgment on a present load mode of said engine;

calculating a basic injection quantity corresponding to a present accelerator opening and engine speed from a previously stored running characteristic map indicating a relationship between an engine speed and a fuel injection quantity for each of accelerator openings, including an accelerator opening of zero percent;

judging whether or not said vehicle is in a predetermined idle mode from an operating condition of said vehicle;

calculating a learning value on the basis of an output value of said PID for each load mode when said vehicle is in the idle mode, and storing said learning value;

calculating a corrected basic injection quantity from said basic injection quantity and said learning value on the basis of a predetermined formula according to a value of said basic injection quantity;

calculating a new learning value only when a variation of the output value of said PID exceeds a predetermined value;

updating, when said actual engine speed is greater than said desired engine speed and, at the same time, the output value of said PID is zero, said learning value by subtracting an update quantity of a predetermined value from said learning value until the output value of said PID reaches a predetermined value; and calculating a desired injection quantity by adding said corrected basic injection quantity and the output value of said PID to each other.

9. An idle speed control method according to claim 8, further comprising the steps of:

calculating a maximum allowable injection quantity according to each operating condition of said engine; and replacing, when said desired injection quantity is greater than said maximum allowable injection quantity, said desired injection quantity by said maximum allowable injection quantity.

10. An idle speed control method according to claim 8, further comprising the step of:

judging whether or not the engine speed is stable, so that the calculation of said learning value is executed when said engine speed is stable.

11. An idle speed control method according to claim 10, wherein the judgment as to whether or not said engine speed is stable is executed by calculating a difference between a desired idle speed and an actual engine speed.

12. An idle speed control method according to claim 11, wherein the judgment as to whether or not said engine speed is stable is executed by judging whether or not a state wherein a difference between said desired idle speed and the actual engine speed is smaller than a predetermined value has continued for a predetermined time.

13. An idle speed control method according to claim 8, wherein said new learning value is given as a value determined by subtracting a predetermined offset quantity from a sum of the previously calculated learning value and the output value of said PID.

14. An idle speed control method according to claim 13, wherein the updating of said learning value continues until the output value of said PID becomes equal to said offset quantity.

* * * * *